United States Patent [19]

Peters

[11] Patent Number: 4,803,467

[45] Date of Patent: Feb. 7, 1989

[54] MAGNETIC KEY LOCK PROVIDED WITH AN ALARM SYSTEM

[76] Inventor: George Peters, 201 Ryder Ave., Brooklyn, N.Y. 11230

[21] Appl. No.: 159,209

[22] Filed: Feb. 23, 1988

[51] Int. Cl.[4] ..... E05B 45/06; H01H 27/06

[52] U.S. Cl. ..... 340/542; 200/61.64; 200/61.66

[58] Field of Search ..... 340/542, 527; 200/61.64, 61.66

[56] References Cited

U.S. PATENT DOCUMENTS

| | | | |
|---|---|---|---|
| 3,587,081 | 6/1971 | Hawkins | 340/542 |
| 3,685,036 | 8/1972 | Torok | 200/61.66 |
| 3,781,836 | 12/1973 | Kruper et al. | 340/547 |
| 3,787,812 | 1/1974 | Amstrong | 340/542 |
| 3,962,695 | 6/1976 | Peters | 340/542 |
| 4,249,161 | 2/1981 | Mohnhaupt | 200/61.64 |
| 4,271,405 | 6/1981 | Kitterman | 340/527 |
| 4,370,644 | 1/1983 | Droz | 340/542 |
| 4,465,997 | 8/1984 | Hines | 340/542 |
| 4,471,343 | 9/1984 | Lemelson | 340/542 |
| 4,635,035 | 1/1987 | Ratzabi | 340/542 |

*Primary Examiner*—Joseph A. Orsino
*Assistant Examiner*—Anh H. Tran
*Attorney, Agent, or Firm*—Goodman & Teitelbaum

[57] ABSTRACT

A magnetic key lock provided with an alarm system, the key lock including a normally closed first switch and a normally open second switch, both switches being connected to the alarm system so that the alarm system is activated when the first and second switches are both closed. The second switch is associated with a tumbler of the lock so that the second switch is closed upon movement of the tumbler when a key or lock pick is inserted into the key slot of the lock. A magnetic sensor is provided adjacent to key slot so that a proper magnet-bearing key can activate the magnetic sensor before the second switch is closed by the tumbler movement in order to delay activation of the second switch for a selected time period to allow the proper key to open the first switch while opening the lock for inactivating the alarm system. A futher switch is provided to test the working ability of the alarm system. The alarm system can include a wirelessly controlled remote alarm. When thekey lock is mounted in a door, another switch can be provided to activate the alarm system when the door is forced open without using the proper key, where the alarm system can be controlled by a latch knob mounted inside the door.

20 Claims, 3 Drawing Sheets

MAGNETIC KEY LOCK PROVIDED WITH AN ALARM SYSTEM

BACKGROUND OF THE INVENTION

This invention relates to a key lock, and more particularly, to a magnetic key lock provided with an alarm system. The key lock includes a normally closed first switch connected to the alarm system, and a normally open second switch associated with a tumbler of the lock, and also connected to the alarm system so that the alarm system is activated when the second switch is closed upon movement of the associated tumbler by a key or pick inserted into the key slot of the lock. Additionally, a magnetic sensor is provided adjacent the key slot so that a proper magnet-bearing key can activate the magnetic sensor before the second switch is closed by the tumbler movement in order to delay the activation of the second switch for a selected time period to allow the proper key to turn the lock cylinder in order to open the first switch, and, therefore, inactivate the alarm system.

In my U.S. Pat. No. 3,962,695, I disclosed a Magnetic Key Lock And Alarm, including a pair of switches located at the rear end of the key slot of the magnetic key lock. One of the switches is normally open and is closed by any key engaging the switch when the key is fully inserted into the key slot. The second switch is normally closed, and includes a mass of iron thereon to be directed by a magnet embedded in a proper key in order to open the second switch when the key is fully inserted in the key slot. The alarm and the first and second switches are connected in a series circuit to cause the alarm to sound when both the first and second switches are closed upon the insertion of a non-magnet bearing key in the key slot.

Due to the constant engagement and disengagement of the first switch of my above patent by the insertion of the key, it is possible that the first switch can be bent, or even broken by the key or a lock pick, thus inactivating the alarm. Furthermore, it is noted, that after continuous use, the second switch could become very flexible and contact the proper magnet-bearing key when inserted in the key slot, so that the magnet-bearing key, if fabricated from metal, would become part of the electrical circuit and cause the alarm to sound. Therefore, there is a need for an improved magnetic key lock which overcomes the above structural defects of my above-mentioned patent.

SUMMARY OF THE INVENTION

It is, accordingly, an object of the present invention to provide a magnetic key lock provided with an alarm system which avoids the problems of the prior art devices.

Another object of the present invention is to provide a magnetic key lock provided with an alarm system which is responsive to a proper magnet-bearing key in order to open the lock without activating the alarm system.

Still another object of the present invention is to provide a magnetic key lock provided with an alarm system which will activate the alarm system when a non-magnetic-bearing key or lock pick is inserted into the key slot of the lock.

Still a further object of the present invention is to provide a magnetic key lock provided with an alarm system which includes means to test whether or not the alarm system is working.

Still another object of the present invention is to provide a magnetic key lock provided with an alarm system whereby a remote alarm substantially spaced from the lock, can be activated by an unauthorized tampering with the lock.

Yet, another object of the present invention is to provide a magnetic key lock provided with an alarm system, which further includes means to activate the alarm system when the door containing the lock is forced open without unlocking the lock.

And yet still another object of the present invention is to provide a magnetic key lock provided with an alarm system, which includes a normally closed first switch and a normally opened second switch connected to the alarm system, together with a magnetic sensor which can delay the activation of the second switch to allow a proper magnet-bearing key to inactivate the alarm system.

And yet still a further objection of the present invention is to provide a magnetic key lock provided with an alarm system which permits the alarm system to be activated and de-activated outside the door by a proper magnet-bearing key, and inside the door by a latch knob.

Briefly, in accordance with the present invention, there is provided a magnetic key lock provided with an alarm system, the key lock being mounted in a door and being provided with a normally closed first switch and a normally open second switch, both switches being connected to the alarm system. The lock includes a conventional tumbler assembly which permits the activation of a conventional door bolt in response to the rotation of lock cylinder by a proper magnet-bearing key, or by the turning of a latch knob mounted inside the door. The second switch is associated with one of the tumblers of the lock so that the second switch is closed upon movement of the associated tumbler when a key or lock pick is inserted into the key slot of the lock. A magnetic sensor is provided adjacent the key slot so that the proper magnet-bearing key can activate the magnetic sensor before the second switch is closed by the tumbler movement in order to delay the activation of the second switch for a selected time period to allow the proper key to turn the lock cylinder in order to open the first switch while opening the lock, and, therefore, inactivate the alarm system.

The alarm system includes means to test whether or not the alarm system is working. Furthermore, a remote alarm substantially spaced from the door is wirelessly controlled by the circuitry of the alarm system to be activated by an unauthorized tampering with the lock. Additionally, means are provided between the door and the door jamb to activate the alarm system when the door is forced open without using the proper key. The alarm system includes an electrical circuitry to carry out the above functions.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings, like reference characters designate like parts.

DETAILED DESCRIPTION OF THE PREFERRED EMBODIMENT

Figure 1:
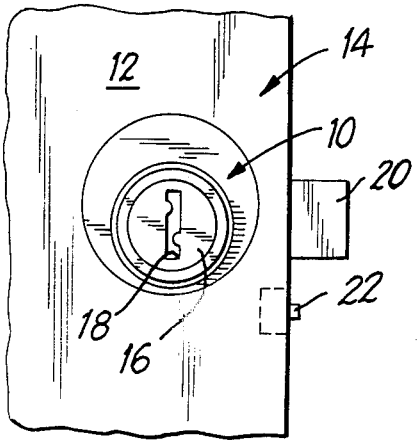
FIG. 1 is a fragmented view showing the outside of a door provided with a magnetic key lock according to the present invention.

Referring now to the drawings, FIG. 1 shows a door lock 10 mounted in the outer side 12 of a conventional door 14. The door lock 10, which appears as a conventional key cylinder lock, includes a rotatable cylinder 16 having a key slot 18 therethrough, where the cylinder 16 controls a conventional bolt 20, shown in the extended locked position, as set forth below. Additionally, a normally open micro-switch 22 is mounted in the edge of the door 14, as will be explained below.

Figure 2:
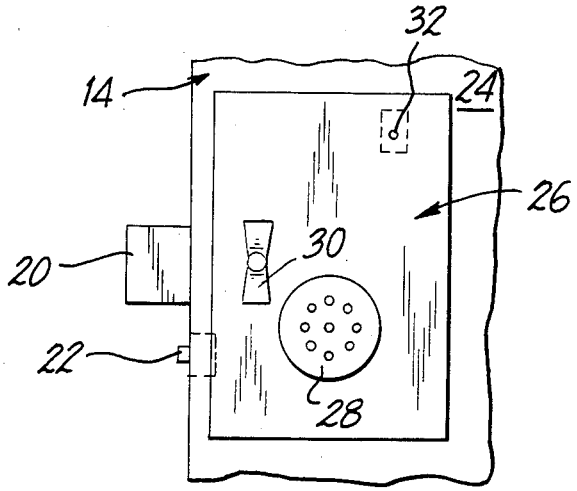
FIG. 2 is a fragmented view showing the other side of the door provided with a housing having an alarm system therein according to the present invention.

FIG. 2 shows the inner side 24 of the door 14, having the housing 26 of the alarm system mounted thereon. The housing 26 includes the alarm horn 28, a latch knob 30 for controlling the bolt 20 from inside the door, and a testing push-button switch 32, all of which will be explained hereinafter below.

Figure 3:
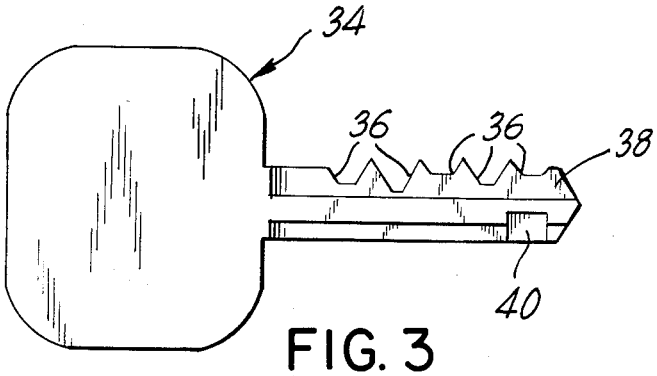
FIG. 3 is an enlarged view showing a magnet-bearing key according to the present invention.

FIG. 3 shows a key 34 according to the present invention. The key 34 appears generally as a conventional key, having the usual serrations 36 along one edge of the key shank 38 for cooperating with conventional tumbler elements of the lock 10 for translating the bolt 20 upon rotation of the cylinder 16 by the key 34. However, the key 34 is modified according to the present invention to include a magnet 40 securely mounted by conventional means in the opposite edge of the key shank 38, where the magnet 40 is positioned near the forward free end of the key shank 38. The magnet 40 is oriented to create a magnetic field adjacent the forward end of the key shank 38, as will be explained below.

Figure 4:
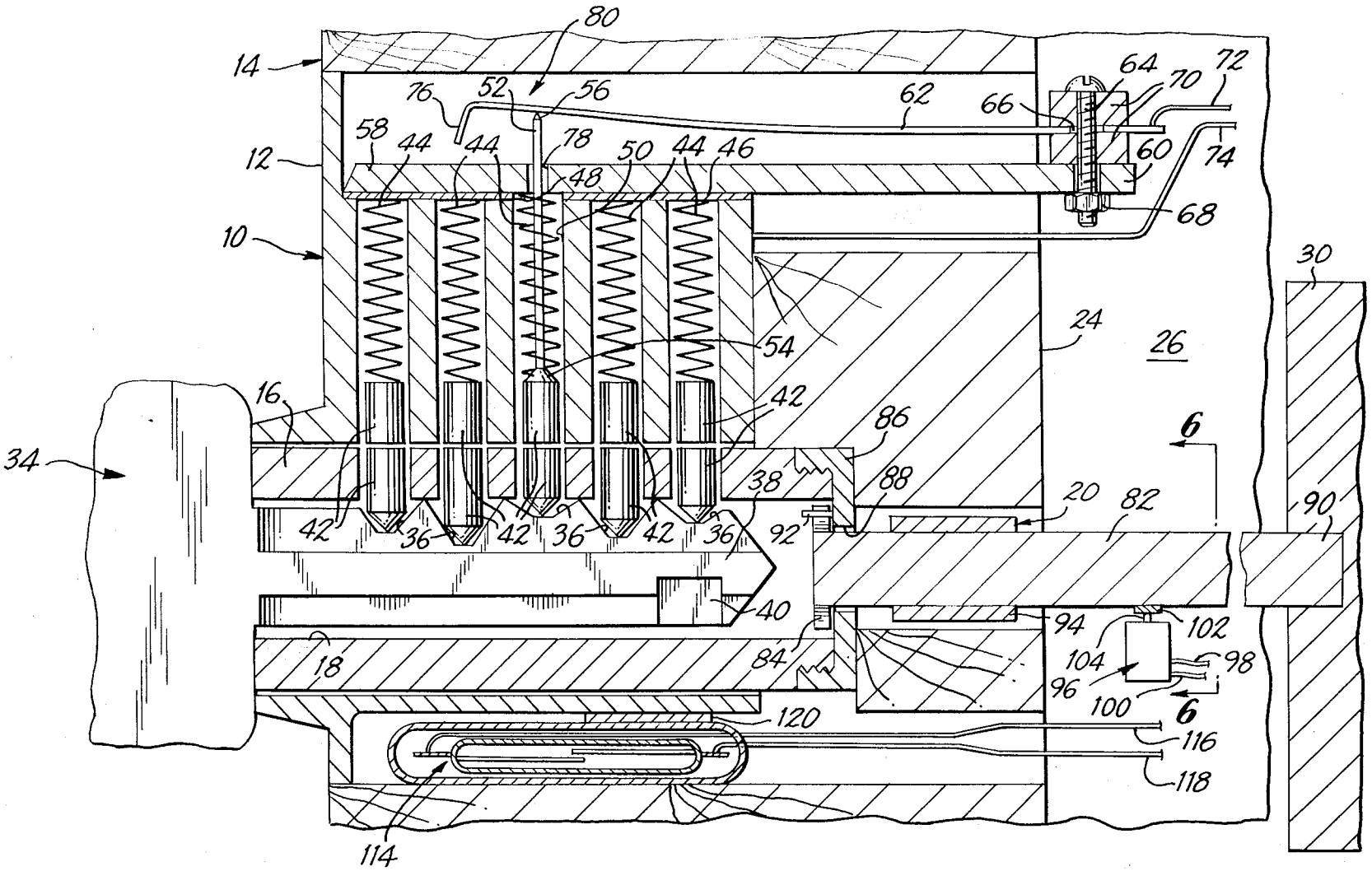
FIG. 4 is a fragmented sectional view of the magnetic key lock showing the magnet-bearing key of FIG. 3 therein, and showing the tumbler and on/off switches of the present invention, together with the magnetic sensor.

FIG. 4 shows a cross section of the lock 10 mounted in a conventional hole formed through the door 14. The key 34 has been inserted into the key slot 18 of the cylinder 16 so that the pairs of conventional tumblers 42 have been moved by the key serrations 36 against the action of the associated tumbler springs 44, wherein the lower tumblers 42 are disposed within the cylinder 16 and the upper tumblers 42 are disposed within the upper portion of the lock 10 to provide a parting line therebetween to permit the cylinder 16 to rotate in a conventional manner well known in the lock art. The springs 44 are confined in a conventional manner by a casing 46. However, a hole 48 is formed through the casing 46 to provide access to the center tumbler bore 50 as explained below.

Figure 5:
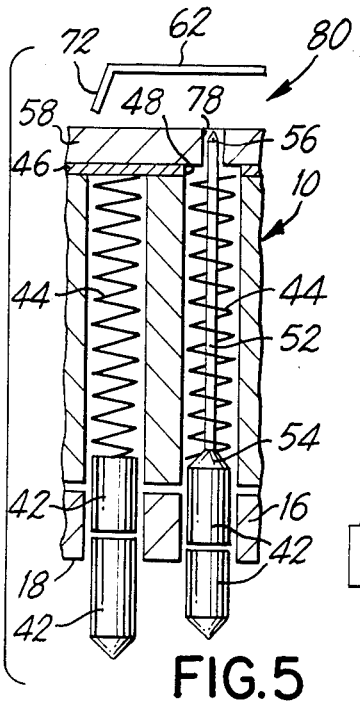
FIG. 5 is a fragmentary sectional view of the center tumblers associated with the tumbler switch, the tumbler switch being in the open position.

A pin 52 having an enlarged head 54 is placed into the center tumbler bore 50 within the turns of the spring 44 so that the head 54 rests on the upper tumbler 42 in the center bore 50. As shown in FIG. 5, the pin 52, when no key is in the key slot 18, normally extends through the hole 48 in the casing 46. Thus, when any key or lock pick is placed into the key slot 18, the tumblers in the center bore 50 will be forced upwardly to also raise the free end 56 of the pin 52, as shown in FIG. 4, the function of which will be described below.

A bar 58 is secured on top of the casing 46 and extends through the door 14 so that an end portion 60 thereof is disposed within the alarm system housing 26 on the inner side 24 of the door 14. A leaf spring contact 62, preferably of bronze material, is mounted on the bar 58 by a screw 64 passing through an opening 66 in the end of the spring contact 62, and secured by a conventional nut 68. A pair of plastic or nonmetal washers 70 are disposed on opposite sides of the spring contact 62 to insulate the spring contact 62 from both the screw 64 and the bar 58. An electrical lead 72 is connected to the secured end of the spring contact 62, and a second electrical lead 74 is grounded to the upper portion of the lock 10, where the leads 72,74 are connected to the alarm system as set forth below.

Preferably, the free end 76 of the spring contact 62 is bent downwardly to provide stiffness thereto. Furthermore, the bar 58 has a hole 78 therethrough in alignment with the center tumbler bore 50 to allow the free end 56 of the pin 52 to pass through the bar 58 in order to engage the spring contact 62 as shown in FIG. 4. Thus, the pin 52 and the spring contact 62 provide a switch hereinafter referred to as a tumbler switch 80, the function of which is set forth below. As noted in the drawings, the hole 78 in the bar 58 has a smaller diameter than the hole 48 in the casing 46 so that the bar 58 functions to confine the spring 44 within the center tumbler bore 50.

A shaft 82 has a cam 84 extending at right angles thereto at the inner end thereof, which is secured within the inner end of the cylinder 16 by a cover nut 86 threaded onto the end of the cylinder 16. The cover nut 86 has a central opening 88 therethrough to permit the shaft 82 to pass through the cover nut 86. The opposite end 90 of the shaft 82 extends through the alarm system housing 26 and is secured by conventional means to the latch knob 30, so that the shaft 82 is held in place.

A pin 92 extends inwardly into the key slot 18 from the cover nut 86 for engagement with the cam 84, as explained below. Additionally, a cam portion 94 of the bolt 20 is mounted on the shaft 82 in a conventional manner well-known in the lock art so that the bolt 20 will translate back and forth as the shaft 82 is rotated either by the cylinder 16 or the latch knob 30. Furthermore, a micro-switch 96 is positioned adjacent the shaft 82 for engagement with the shaft 82 in a manner set forth below. Electrical leads 98, 100 connect the micro-switch 96 to the alarm system as set forth below, where hereinafter the micro-switch 96 is referred to as an on/-off switch 96.

Figure 6A:
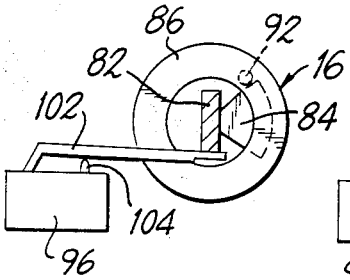
FIGS. 6A and 6D show the on/off switch being closed and opened by rotation of the lock cylinder and the shaft connected to the latch knob.
Figure 6B:
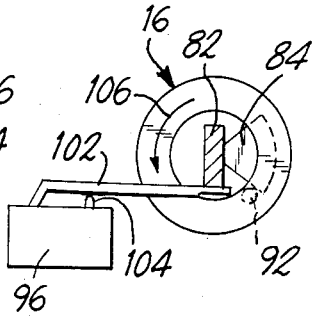
Figure 6C:
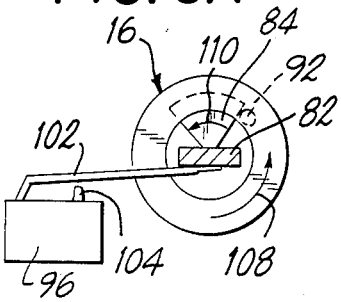

FIGS. 6A–6D show the relationship between the shaft 82 and the on/off switch 96 as the shaft 82 is turned. FIG. 6A shows the lock 10 in the locked position whereby the shaft 82 pushes down on the spring 102 of the on/off switch 96 to depress the button 104 of the on/off switch 96 to activate the on/off switch 96 to the on position. It is noted, that the pin 92 is disposed on one side of the cam 84 of the shaft 82. FIG. 6B shows the cylinder 16 and the cover nut 86 thereon being rotated 270° in the direction of arrow 106 when the proper key 34 is used to rotate the cylinder 16, so that the pin 92 is now rotated to the other side of the stationary cam 84 with the on/off switch 96 still being held in the on position. FIG. 6C shows the key rotating the cylinder 16 and cover nut 86 thereon a further 90° in the direction of arrow 108, so that the pin 92 moves the cam 84 also 90° . Thus the shaft 82 is rotated 90° by the engaged cam 84 thereof in the direction of the arrow 110. In this latter position, the lock 10 is in the open position, and the spring 102 of the on/off switch 96 no longer engages the button 104 so that the on/off switch 96 is now in the off position.

Figure 6D:
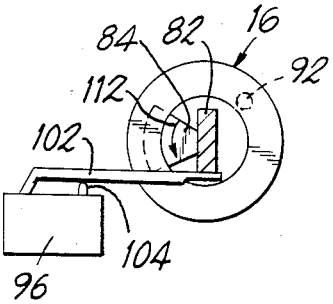

It is noted, as shown in FIG. 6D, that the shaft 82 can be further rotated counterclockwise 90° in the direction of the arrow 112 by the knob 30 so that the shaft 82 contacts the spring 102 of the on/off switch 96 to again depress the button 104 to place the on/off switch 96 in the on position. Obviously, then the knob 30 can rotate the shaft 82 clockwise 90° back to the position shown in FIG. 6C to again unlock the bolt 20 and place the on/-off switch 96 in the off position. It is further noted, that in the position shown in FIG. 6A, the shaft 82 can also be rotated clockwise 90° by the knob 30 to unlock the bolt 20 and place the on/off switch 96 in the off position.

Thus, as indicated above, the cylinder 16, as shown in FIG. 6A, is turned 360° by the proper key 34 to the position shown in FIG. 6C in order to rotate the shaft 82 the required 90° to unlock the bolt 20 and also to position the on/off switch 96 in the off position. However, because of the arrangement of the cam 84 to the pin 92, the knob 30 can directly rotate the cam 84 the required 90° to unlock the bolt 20 and place the on/off switch 96 in the off position. Accordingly, to again lock the bolt 20, and place the on/off switch 96 in the on position, either the cylinder 16 must be turned 360° in the opposite direction, or the knob 30 must be turned 90° in the opposite direction in order to rotate the shaft 82 the required 90° back to the original starting position mentioned above with respect to FIG. 6A.

FIG. 4 further shows a commercially available reed switch 114, which is sensitive to a magnetic field, and, therefore, is hereinafter referred to as a magnetic sensor 114. Electrical leads 116 and 118 are connected to the magnetic sensor 114, where lead 116 is connected to lead 98 of the on/off switch 96, and lead 118 is connected to the alarm system as set forth below. Additionally, a commercially available mumetal shield 120, well known in the magnet art, is disposed over the rear portion of the magnetic sensor 114 to shield the magnetic sensor 114 from the key magnet 40 once the key shank 38 has been fully inserted into the key slot 18 as shown in FIG. 4.

Now, before discussing the electrical circuitry of the alarm system, the mechanical operation of the magnetic key lock 10 will now be discussed in relationship to the tumbler switch 80, the on/off switch 96 and the magnetic sensor 114. The bolt 20 is first positioned in its extended locked position as shown in FIGS. 1 and 2, either by locking the lock 10 with the proper key 34 from outside the door, or by turning the latch knob 30 to the locked position from inside the door. In this locked position, the tumbler switch 80 is open, see FIG. 5, and the on/off switch 96 is on, see FIG. 6A. Thereafter, if an improper key or lock pick is inserted into the key slot 18 in an attempt to unlock the lock 10, the improper key or lock pick will cause all the tumblers 42 to move up and down, so that the center tumbler 42 will cause the pin 52 to move upwardly and into engagement with the spring contact 62 to close the tumbler switch 80, see the position shown in FIG. 4. Thus, with the tumbler switch 80 now closed and the on/off switch 96 in the on position, the alarm system will cause the alarm horn 28 to sound, as explained below.

Furthermore, when the door 14 is closed so that the door micro-switch 22 is engaged against the door jamb, the micro-switch 22 is in a closed position. Thereafter, if the bolt 20 is extended into its locked position, so that the on/off switch 96 is in the on position in a manner set forth above, anyone forcing open the door 14 will place the door micro-switch 22 in its open position, which, in turn, will cause the alarm system to sound the alarm horn 28, as set forth below. Thus, as shown above, the door 14 cannot be forced open nor can it be opened by an unauthorized person picking the lock 10.

When using the proper key 34 to unlock the door 14, the key 34 is inserted into the key slot 18. Accordingly, the magnetic sensor 114 will sense the magnet 40 in the key shank 38 before the key shank 38 engages the center tumblers 42 which close the tumbler switch 80. Thus, the magnetic sensor 114 will cause the alarm system to ignore the tumbler switch 80 for a pre-determined time, preferably for 7 seconds, when the tumbler switch 80 is closed, thereby allowing the key 34 to turn the cylinder 16 and shaft 82 in order to place the on/off switch 96 in the off position before the end of the above-mentioned pre-determined time period. Accordingly, when the tumbler switch 80 can finally be activated, the time period, after the on/off switch 96 has been placed in the off position by the proper key 34, so that the alarm horn 28 will not sound because the on/off switch 96 at that moment is in the off position, as set forth below.

It is further noted, that when the latch knob 30 is turned to the unlocked position so that the on/off switch 96 is in the off position, the door 14 can be opened because the door micro-switch 22 and even the tumbler switch 80 have no effect when activated after the on/off switch 96 is in the off position.

Figures 7, 8:
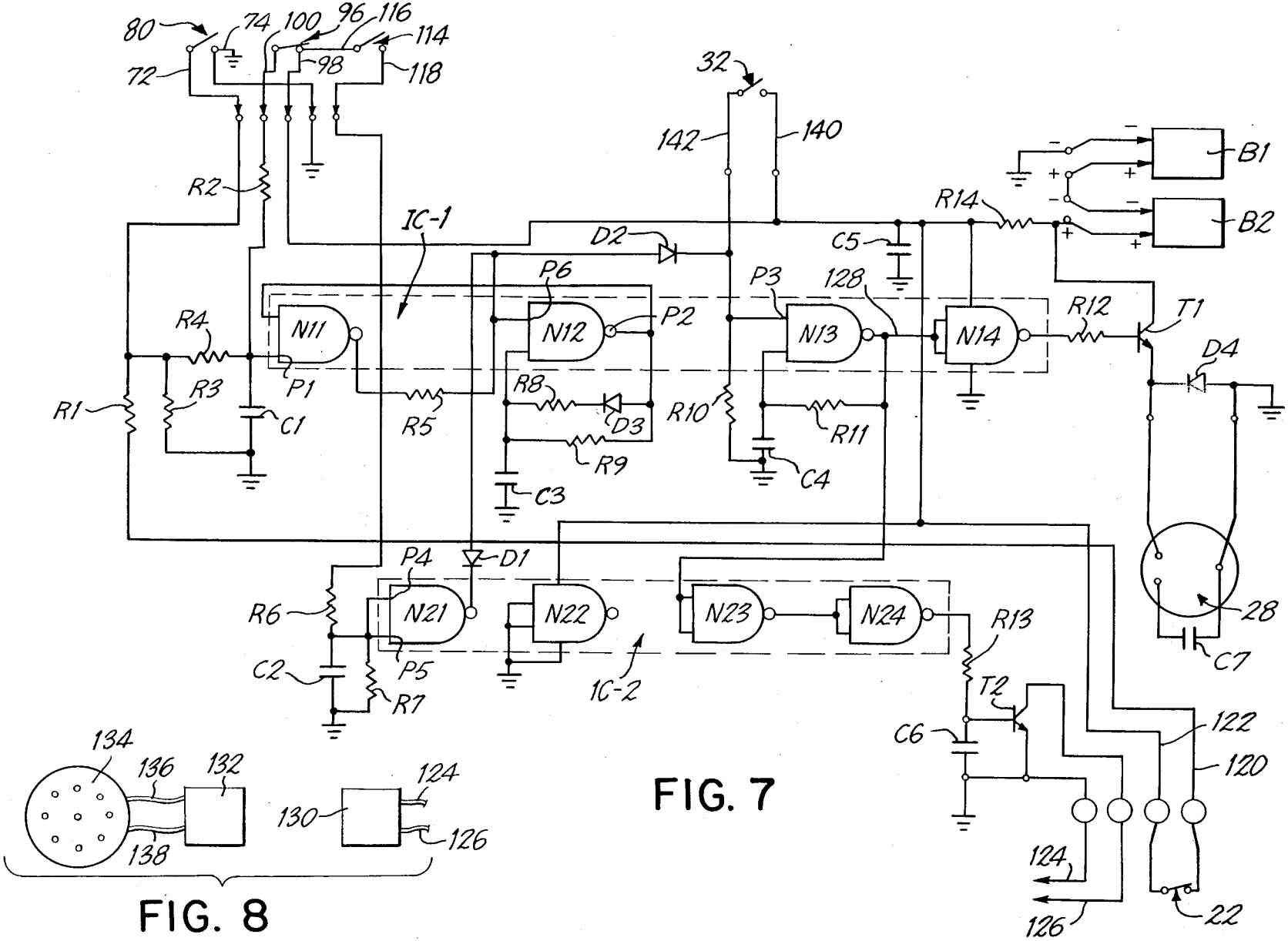
FIG. 7 shows the electrical circuitry of the alarm system.
FIG. 8 shows the wireless remote alarm.

In accordance with the above, the electrical circuitry of the alarm system as best shown in FIG. 7 will now be discussed. The alarm system circuitry includes two integrated circuits IC-1 and IC-2 and various discrete components selected for reliability, and economy of the required power for the alarm system. The alarm system is powered by two 9 volt batteries B1 and B2 connected in series to provide 18 volts. The integrated circuit IC-1 includes four NAND gates N11, N12, N13 and N14, where the second integrated circuit IC-2 also includes four NAND gates N21, N22, N23 and N24.

The on/off switch 96, when in the on position, as shown in FIG. 7, has lead 98 connected in series through resistor R14 (680 ohms) to the batteries B1 and B2, which are then connected to ground. A capacitor C5 (100 ufd) is connected to ground parallel to the resistor R14 and batteries B1, B2. The other lead 100 of the on/off switch 96 is connected in series through the resistor R2 (10K ohms) to point P1 of the NAND gate N11 of the integrated circuit IC-1.

Accordingly, when the on/off switch 96 is in the on position, the actuation or closing of the tumbler switch 80, in the manner set forth above, by an improper key or lock pick, will cause the point P1 of the NAND gate Nll to go low after a time delay, as determined by the capacitor C1(0.01 ufd) and the resistor R1 (1M ohms). For reliability, a resistor R3 (10M ohms) is positioned parallel to the capacitor C1 in addition to the resistor R4 (100K ohms), where the register R4 is also in series with the resistor R1 relative to the point P1. When the point P1 is low, the bi-stable NAND gates N11 and N12 will turn on, so that the point P2 of the NAND gate N12 will go high for a pre-determined time, as determined by the resistor R9 (10M ohms) and the capacitor C3 (10 ufd). This pre-determined high time for point P2 is the alarm time, being approximately 30 seconds. The NAND gate N12 also includes a resistor R8 (100K ohms) connected in series with a diode D3; which are connected parallel to the above mentioned resistor R9 for reliability of the circuit. It is further noted, that a resistor R5 (1M ohms) is connected between the NAND gates N11 and N12.

The above mentioned high of point P2 is then applied through the diode D2 to the point P3 of the NAND gate N13. Accordingly, due to the high of point P3, the bi-stable NAND gate N14 now turns on and oscillates (1 hz). The NAND gate N13 has a resistor R10 (10M ohms), a capacitor C4 (0.1 ufd) and a resistor Rll (6.8M ohms) connected in series therewith for reliability of the circuit. The integrated circuit IC-1 now applies the oscillating voltage of the NAND gate N14 through the resistor R12 (1M ohms) to the base of the emmitter follower transistor T1, which activates the alarm horn 28. A diode D4 and a capacitor C7 (0.1 ufd) are connected to the alarm horn 28 for reliability thereof.

Thus, it has been shown above how the closing of the tumbler switch 80 activates the alarm horn 28. Accordingly, the door micro-switch 22 is connected by electrical line 120 to the above mentioned point P1 of the NAND gate N11, and is connected by another line 122 to the NAND gate N22 of the second integrated circuit IC-2, which is connected to ground. Thus, when the door micro-switch 22 is placed in the off position by forcing the door open while the on/off switch 96 is in the on position, the point P1 of the NAND gate N11 will go low after a time delay, whih will cause the activation of the alarm horn 28 in the same manner as mentioned above even though the tumbler switch 80 is still in the open position.

It is noted, that when the on/off switch 96 is in the off position, and the tumbler switch 80 is in the open position, and/or the door micro-switch 22 is in the on position, a high is applied to the point P1 of the NAND gate N11 through the resistor R2. The point Pl is held in this high regardless of whether the tumbler switch 80 is now closed, or the door microswitch 22 is now placed in the off position. Accordingly, when the point P1 is in the above mentioned high, the alarm horn 28 cannot be activated by the integrated circuit IC-1.

If a proper key 34 is inserted into the cylinder when the on/off switch 96 is in the on position, and the door microswitch 22 is also in the on position, the magnetic sensor 114 will be activated or closed before the tumbler switch 80 is closed, as set forth above. Accordingly, the closing of the magnetic sensor 114 will cause the capacitor C2 ( 1 ufd) to charge to a high through the resistor R6 (2.2K ohms). This high of the capacitor C2 is then applied to the points P4 and P5 of the NAND gate N21 of the integrated circuit IC-2. A resistor R7 (10 M ohms) is placed in series with the capacitor C2 for reliability of the circuit. The high on points P4 and P5 of the NAND gate N21 of the integrated circuit IC-2 causes a low to be applied to point P6 of the NAND gate N12 of the integrated circuit IC-1 through the diode D1.

Accordingly, the NAND gate N12 is held off for the duration of the time that the disable NAND gate N21 is at the above-mentioned high, the duration of the hold off time being preferably approximately 7 seconds as determined by capacitor C2 and resistor R7. Thus, the integrated circuit IC-1 is made inactive during this hold off time, so that if the on/off switch 96 is placed in the off position during this hold off time, the alarm horn 28 will not be activated once the on/off switch 96 is in the off position, even though the tumbler switch 80 has been closed. Obviously, if the on/off switch 96 is not placed in the off position during the above mentioned hold off time, the alarm horn 28 will be activated in the manner set forth above.

It is noted, that the circuitry of the alarm system has provision for an external alarm horn, where electrical lines 124 and 126 are connected to the external alarm system. The lines 124, 126 are internally connected to the NAND gates N23 and N24 of the second integrated circuit IC-2 through the transistor T2 and the resistor R13 (1 M ohms) and the capacitor C6 (0.01 ufd). The NAND gates N23, N24 are connected to electrical line 128 between the NAND gates N13 and N14 of the integrated circuit IC-1 in order for the external alarm system to be activated in the same manner that the alarm horn 28 is activated, as set forth above.

As shown in FIG. 8, the lines 124 and 126 are preferably connected to a commercially available transmitter 130, which is well known in the transmitter art. Accordingly, a commercially available receiver 132 is provided to receive the signals from the transmitter 130, where such wireless transmission is well known in the transmitter and receiver art. An external alarm horn 134 is connected by electrical leads 136, 138 to the receiver 132. Accordingly, the external alarm horn 134 will be activated at the same time the above mentioned alarm horn 28 is activated. It is noted, that if desired, the internal alarm horn 28 can be shut off or eliminated so that the only alarm sound would be sounded by the external alarm horn 134. Obviously, more than one external alarm horn or system can be activated by the above mentioned electrical circuitry using the two integrated circuits IC-1 and IC-2.

Finally, as shown in FIG. 7, the testing switch 32 is connected by electrical line 140 to the batteries B1, B2, and is further connected by line 142 to point P3 of the NAND gate N13 of the integrated circuit IC-1. Accordingly, regardless of the state of the tumbler switch 80, the on/off switch 96, the magnetic sensor 114 and the door micro-switch 22, when the testing switch 32 is closed by pushing the button thereof, a high is applied to point P3 so that the NAND gate N14 is turned on and oscillates in the same manner set forth above to activate the alarm horn 28. Thus, the testing switch 32 is used to see if the alarm horn 28 and batteries B1, B2 are in working condition.

Numerous alterations of the structures and electrical components herein disclosed will suggest themselves to those skilled in the art. However, it is to be understood that the present disclosure relates to a preferred embodiment of the present invention, which is for the purpose of illustration only, and is not to be construed as a limitation of the present invention.

What is claimed is:

1. A magnetic key lock being opened and locked by a proper associated magnet-bearing key, said key lock comprising:

a key slot for receiving the proper associated magnet-bearing key therein to open and lock said key lock;

an alarm system including electrical means to activate said alarm system when an improper key, lock pick and the like is inserted into said key slot;

first and second switches electrically connected to said electrical means of said alarm system, said first switch being normally closed when said key lock is locked, and said first switch being open when said key lock is open, said second switch being normally open when nothing is inserted in said key slot;

said electrical means activating said alarm system when said first and second switches are both closed, said second switch being closed when a key, lock pick and the like is inserted into said key slot, said alarm system normally being inactivated when said first switch is open; and magnetic sensor means electrically connected to said electrical means of said alarm system to delay activating effect of said second switch on said electrical means when said second switch is closed by the insertion of the proper magnet-bearing key in said key slot;

said magnetic sensor means being disposed adjacent to said key slot to be activated by the proper magnet-bearing key when inserted into said key slot;

said delay being for a selected time period in order to allow the proper magnet-bearing key to open said key lock and, at the same time, open said first switch to inactivate said alarm system.

2. A magnetic key lock according to claim 1, wherein a tumbler assembly is associated with said key slot for cooperating with the proper magnet-bearing key to open and lock said key lock, said second switch being associated with said tumbler assembly, said second switch being closed upon movement of a preselected tumbler of said tumbler assembly when a key, lock pick and the like is inserted into said key slot.

3. A magnetic key lock according to claim 2, wherein said preselected tumbler is positioned rearwardly along said key slot relative to a forward position of said magnetic sensor means so that the proper magnet-bearing key can activate said magnetic sensor means before said second switch is closed by the movement of said preselected tumbler.

4. A magnetic key lock according to claim 2, wherein said second switch includes a pin and a spring contact spaced above said pin, said pin resting on said preselected tumbler so that upward movement of said preselected tumbler raises said pin into contact with said spring contact to close said second switch.

5. A magnetic key lock according to claim 1, wherein said key slot is provided in a rotatable lock cylinder which is rotated by the proper magnet-bearing key to open and lock said key lock, shaft means connected to a rear portion of said lock cylinder for rotation therewith when said key lock is opened and locked, said shaft means engaging said first switch to close said first switch when said key lock is locked, and said shaft means being out-of-engagement with said first switch to open said first switch when said key lock is open.

6. A magnetic key lock according to claim 5, wherein said first switch is an on/off switch.

7. A magnetic key lock according to claim 5, wherein said key lock is mounted in an outer side of a door, bolt means connected to said shaft means so that said bolt means is in an extended locked position when said key lock is locked, and said bolt means is in a retracted opened position when said key lock is open, said bolt means permitting said shaft means to be rotated ninety degrees relative to said lock cylinder to open and close said first switch without rotating said lock cylinder.

8. A magnetic key lock according to claim 7, wherein a latch knob is mounted on an inner side of the door, said latch knob being connected to said shaft means to rotate said shaft means said ninety degrees to control said opened and locked positions of said bolt means and also to open and close said first switch.

9. A magnetic key lock according to claim 5, wherein a tumbler assembly is associated with said key slot for cooperating with the proper magnet-bearing key to open and lock said key lock, said second switch being associated with said tumbler assembly, said second switch being closed upon movement of a preselected tumbler of said tumbler assembly when a key, lock pick and the like is inserted into said key slot.

10. A magnetic key lock according to claim 9, wherein said preselected tumbler is positioned rearwardly along said key slot relative to a forward position of said magnetic sensor means so that the proper magnet-bearing key can activate said magnetic sensor means before said second switch is closed by the movement of said preselected tumbler.

11. A magnetic key lock according to claim 9, wherein said second switch includes a pin and spring contact spaced above said pin, said pin resting on said preselected tumbler so that upward movement of said preselected tumbler raises said pin into contact with said spring contact to close said second switch.

12. A magnetic key lock according to claim 1, wherein said key lock is mounted in a door, switch means mounted in an edge of the door to activate said alarm system when the door is forced open with said first switch being closed.

13. A magnetic key lock according to claim 12, wherein said switch means is a micro-switch which is held in an open position when the door is closed.

14. A magnetic key lock according to claim 1, wherein said alarm system includes switch means to test the working condition of said alarm system.

15. A magnetic key lock according to claim 1, wherein said electrical means of said alarm system includes D.C. batteries.

16. A magnetic key lock according to claim 1, wherein said alarm system includes a wirelessly controlled remote alarm.

17. A magnetic key lock according to claim 16, wherein said remote alarm includes a receiver electrically connected to an alarm horn, and a transmitter connected to said alarm system to send signals to said receiver.

18. A magnetic key lock according to claim 1, wherein said magnetic sensor means includes a reed switch sensitive to a magnetic field.

19. A magnetic key lock according to claim 18, wherein a mu-metal shield is disposed over a rear portion of said reed switch to shield said reed switch from the magnet-bearing key once the magnet-bearing key has been fully inserted in said key slot.

20. A magnetic key lock according to claim 19, wherein the magnet-bearing key has a magnet mounted near a forward free end thereof for co-action with said mu-metal shield.

* * * * *